US005834151A

United States Patent [19]

Wada

[11] Patent Number: 5,834,151

[45] Date of Patent: Nov. 10, 1998

[54] IMAGE FORMING METHOD

[75] Inventor: Yasunori Wada, Hino, Japan

[73] Assignee: Konica Corporation, Japan

[21] Appl. No.: 827,051

[22] Filed: Mar. 25, 1997

[30] Foreign Application Priority Data

Mar. 29, 1996 [JP] Japan ..... 8-076557

[51] Int. Cl.[6] ..... G03C 1/765; G03C 8/52; G03C 11/06

[52] U.S. Cl. ..... 430/201; 430/200; 430/203; 430/220; 430/207; 430/346; 430/353; 430/496; 430/950; 503/227

[58] Field of Search ..... 430/201, 203, 430/220, 950, 207, 496, 200, 346, 353; 503/227

[56] References Cited

U.S. PATENT DOCUMENTS

| | | | |
|---|---|---|---|
| 3,833,368 | 9/1974 | Land et al. | 430/220 |
| 4,040,830 | 8/1977 | Rogers et al. | 430/220 |
| 4,568,403 | 2/1986 | Egan | 156/247 |
| 4,770,970 | 9/1988 | Schranz et al. | 430/203 |
| 4,952,479 | 8/1990 | Aono et al. | 430/203 |
| 5,437,956 | 8/1995 | Nakamura et al. | 430/203 |
| 5,501,938 | 3/1996 | Ellis et al. | 430/201 |
| 5,587,269 | 12/1996 | Degieuw | 430/950 |

FOREIGN PATENT DOCUMENTS

| | | |
|---|---|---|
| 1484772 | 5/1966 | France . |
| 2328576 | 10/1975 | France . |
| 2632566 | 6/1988 | France . |
| 1564307 | 9/1976 | United Kingdom . |

OTHER PUBLICATIONS

Search Report EP 97 30 2113 with Annex J.M. Eder, XP002033287 p. 187, line 1–p. 190, line 24.

Patent Abstracts of Japan, vol. 11, No. 71 (M–567), 4 Mar. '87 & JP 61 227086 A (Fuji Photo Film Company Limited), 9 Oct. '86 Abstract.

*Primary Examiner*—Richard L. Schilling
*Attorney, Agent, or Firm*—Jordan B. Bierman; Bierman, Muserlian and Lucas

[57] ABSTRACT

A method of forming an image on an image forming material is disclosed which comprises a transparent support having a first surface side and a second surface side and provided on the first surface side, an imaging layer, the method comprising the step of forming a mirror image on the imaging layer so that the formed image is visible from the second surface side, wherein the second surface side has a glossiness of 80 to 115.

7 Claims, 1 Drawing Sheet

IMAGE FORMING METHOD

FIELD OF THE INVENTION

The present invention relates to an image forming method especially suitable for medical use.

BACKGROUND OF THE INVENTION

Conventionally, a medical CT or MRI image has been photographed on a silver halide photographic light-sensitive material using a CRT camera or image-formed on the silver halide photographic light-sensitive material by means of laser exposure. A medical diagnostic image is usually placed on a viewing box and read as a transmissive image. In this occasion, if glossiness on the surface is excessive, reflected light enters into the view field together with an image. Accordingly, if the image is read for a long time, such glossiness on the surface causes fatigue. Specifically, aforesaid reflection was especially troublesome at high image density.

In a conventional silver halide photographic light-sensitive material, in order to prevent aforesaid problem, a matting agent of several $\mu$m was added onto the surface layer thereof for reducing glossiness on the surface. On the contrary, however, in a thermal transfer method, a diffusion transfer method, a thermal recording method and a heat developable method, processing an image formation surface to reduce glossiness is accompanied by reduction of image quality or deterioration of the apparatus (due to abrasion of a member when there are members such as a thermal head which contacts an image formation surface), or causes inconvenience such as an increase of surface glossiness while passing through an image forming process. Therefore, it was substantially difficult to reduce surface glossiness.

For example, in the thermo-sensitive transfer method, if the surface of the image-receiving layer on which an image is formed is matted to an extent to achieve objective glossiness, a transfer failure and reduction of resolution occur when aforesaid image is transferred from the transfer layer such as an ink sheet. Similarly, in the case of diffusion transfer, diffusion speed from the transfer layer to the image-receiving layer and efficiency are reduced so that resolution and sensitivity are in tern also reduced. When an image is formed on the thermosensitive material with a thermal head, the head is deteriorated due to abrasion and resulting heating unevenness. In the case when a heat developable process is included, it is preferable that the image forming layer is directly heated from the viewpoint of heat transfer efficiency. When the image forming layer is heated, the surface thereof is flattened by means of the roller so that the surface glossiness is increased. However, further, when a heated roller with a coarsened surface is used, the surface glossiness of the image forming layer is reduced. However, since heat transferring is not uniform, resolution is reduced and also the surface of the roller is clogged over time so that minute development unevenness occurs.

Since one of the objects of a medical image is to observe the image, frequency to touch the image by hand directly is high. Accordingly, traces of fingerprints tend to adhere to the image. However, if such smudged image surface is cleaned, it was often stained or scratched.

In addition, lamination processing is often employed to protect the image formation layer. However, this results in inconvenience such as increase of cost and apparatus complexity and additional consumption of labor. In addition, if, in order to protect the image, adherence of another sheet such as a lamination on the image formation surface or coating of a resin layer is employed, it was discovered that the Newton ring occurs, viewed from the image formation surface, interfering observation.

SUMMARY OF THE INVENTION

A first object of the invention is to provide an image forming method which gives an image easy to observe. A second object of the invention is to provide an image forming method which is difficult to produce stains on a formed image and can easily clear produced stains from the formed image. A third object of the invention is to provide an image forming method without lowering of sensitivity, to give an image with excellent quality and reduced glossiness.

DETAILED DESCRIPTION OF THE INVENTION

Figure 1:
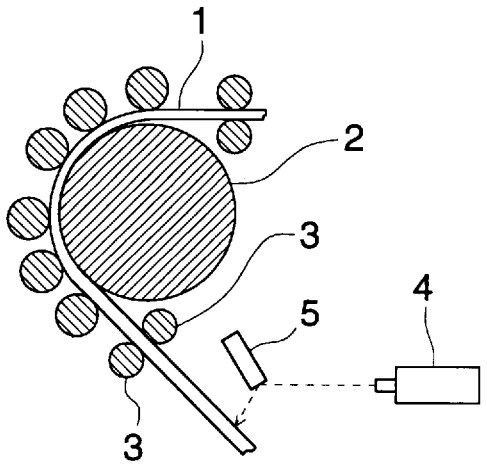
FIG. 1 is a sectional view showing one embodiment of the image forming method of the invention comprising the step of bringing an image forming layer into contact with a heated roller.

The above object of the invention can be attained by a method of forming an image on an image forming material comprising a transparent support having a first surface side and a second surface side and provided on the first surface side, an imaging layer, the method comprising the step of forming a mirror image on the imaging layer so that the formed image is visible from the second surface side, wherein the second surface side has a glossiness of 80 to 115.

The imaging layer herein referred to is a layer on which an image is formed or received, and may be an image forming layer or a image receiving layer according to an image forming method.

The following constitution is preferable since the invention is further effected: the image forming method described above, wherein the maximum density of the formed image is not less than 2.5, the image forming is carried out by image transfer, the image forming is carried out by heating, the image forming is carried out by heat development comprising the step of bringing the imaging layer into contact with a heated roller or the image forming material having a thickness of 10 to 140 $\mu$m in which a protective sheet is adhered onto the image forming layer or a protective resin layer is laminated onto or coated on the imaging layer.

The present inventors have noted that the medical image is an image in which a transmitted image is observed and thereby discovered that it is possible to separately provide a heating side on the surface of a support opposite an observation side, by utilizing that it is possible to observe the image from the rear support surface. Due to this, the heating side can have a surface structure optimal for heating, and the surface glossiness on the observation surface could be minimized without reducing sensitivity.

With regard to interference stripes, we assume that it is caused by an interference, when an image forming layer is observed, of light which passed a support of an image forming layer and a reflected light from an interface between the image formation surface and the lamination layer. Accordingly, by controlling the thickness of the support of the image forming layer, aforesaid interference stripes was improved.

The invention will be explained in detail below.

The statement "forming a mirror image on an image forming layer side of an image forming material" referred to in the invention means that a mirror image is visible when the image is observed from the image forming layer side.

The transparent support referred to in the invention may be transparent in such a manner that an image can be observed through the surface of the support opposite the image forming layer. The material for the support is not specifically limited, and the optimal support can be used according to an image forming method, a manufacturing method of an image forming material or an image forming layer provided thereon. In view of strength, stability or durability, the material for the support includes an acryl resin resin such as polyacrylate or polymethacrylate, a polyester resin such as polyethyleneterephthalate, polybutyleneterephthalate, polyethylenenaphthalate, polycarbonate or polyarylate, a polyolefin resin such as polyvinyl chloride, polyvinylidene chloride, polyvinylidene fluoride, polyethylene, polypropylene or polystyrene, a polyamide resin such as nylon or aromatic polyamide, polyether etherketone, polysulfone, polyether sulfone, polyimide, polyether imide, polyparabanic acid, a phenoxy resin, an epoxy resin, a urethane resin, a melamine resin, an alkyd resin, a phenol resin, a fluorine-containing resin, a silicone resin, and a cellulose polymer. Specifically, polyethylene terephthalate (PET), syndiotactic polystyrene (SPS) or polyethylene naphthalate (PEN) is preferably used.

The thickness of the support is preferably 2 to 200 $\mu$m, more preferably 10 to 130 $\mu$m, and most preferably 10 to 100 $\mu$m.

One of objects of the present invention is to minimize the surface reflection. It is preferable to use methods in which the surface glossiness is inhibited by processing the surface of the support.

There is no practical limit to the image forming material of the present invention. A conventional silver halide photographic light-sensitive material, a heat-developable light-sensitive material, a material utilizing diffusion transfer, a micro-capsule, a thermo-sensitive material and a thermo-pressure material can be used. Specifically, with regard to surface glossiness, the heat-developable light-sensitive material and the thermo-sensitive material are greatly effective.

An image transfer system of the present invention is referred to as, so-called, a thermal transfer process and a diffusion transfer process in which an image is formed by transferring an image imagewisely from an image transfer sheet to an image-receiving sheet.

The former type mainly includes a sublimation type and a heat-fusion type. The sublimation type thermal transfer method is generally referred to as a method in which an image-receiving layer in an image-receiving sheet comprising an image-receiving layer on a support and an ink layer on an inked sheet for thermal transfer recording comprising an ink layer containing a heat diffusible dye (containing a sublimable dye) on a support are superposed, a heat diffusive dye is diffused and moved into the above-mentioned image-receiving layer by heating imagewisely and thereby an image is formed in the image-forming layer.

The heat-fusion type transfer method is referred to as a method similar to the above-mentioned sublimation type transfer method in which a dye and a pigment layer are transferred due to heating in place of transferring the heat diffusion dye.

The heat sensitive recording method referred to as the present invention is a method in which an image is formed by coloring or color-developing aforesaid image due to heat obtained through light-heat converting energy by a thermal head or a laser exposure. It is a method to color or color-develop due to producing chemical reaction by heat, for example, a color-developing agent sealed in a micro-capsule is dissolved with heat so that an image is color-developed due to reacting with a dye precursor existing around the color-developing agent or phthalaldehyde is color-developed by polymerizing with heat in which a cobalt compound is a catalyst.

In the invention, the image forming method, which comprises a heat development process of bringing an image forming layer into contact with a heated roller, is, for example, an image forming method comprising a process of forming an image by heating as in heat developable silver halide material, wherein heating is carried out by bringing an image forming layer into contact with a heated roller.

An image obtained in the present invention provides great effects if it is in the field of observing a transmitted image. It is especially effective in the field of medical imaging. As a preferable example, images such as CT, MRI or CR, regarded as electrical signals, are printed out on an image forming material. In such an occasion, in order to read the outputted image, those having less surface reflection are preferable for observing numerous number of sheets. In addition, since the outputted image is manually handled, fingerprints may be adhered. An image smudge with fingerprints is troublesome in interpreting.

Glossiness referred to in the invention means degree of glisten due to image reflection, the improvement of which is one object of the invention. The glossiness is measured at an angle of 60° employing a photometer VGS-ID produced by Nihon Denshoku Kogyo Co., Ltd. according to JIS Z8741 (60° glossiness). When the glossiness is in the range of 80 to 115, the surface glossiness is considered to be restrained. In order to obtain such a glossiness, the surface of the support is roughened. The method of roughening the surface includes a method of coating a layer containing a matting agent on the support or a method of applying pressure to the surface of the support using a roughened roller. The matting agent includes inorganic fillers such as silica, and organic fillers such as polyethylene resin particles, fluorine-containing resin particles, guanamine resin particles, acryl resin particles, silicone resin particles, and melamine resin particles. Measurement of glossiness needs to be carried out at image portions with Dmin. (at image portions without image density), since degree of glossiness varies due to image density.

In the invention, in order to improve image stability, finger print resistance, scratching resistance or image surface glossiness, a protective sheet is adhered to the image forming layer having an image or a protective resin layer is laminated onto or coated on the image forming layer having an image. The former is, for example, a laminate sheet comprised of a transparent support and an adhesive layer provided thereon, and the latter is, for example, a transfer sheet having a support and a resin layer provided thereon, in which only the resin layer is transferred. The transfer sheet preferably contains a UV absorber or stabilizing agent, for example, those disclosed in Japanese Patent O.P.I. Publication Nos. 58-149048, 5-92670 and 5-124362.

The thickness of the resin layer in the transfer sheet is 0.1 to 10 $\mu$m, preferably 0.3 to 5 $\mu$m, and the thickness of the laminate sheet is 3 to 200 $\mu$m, preferably 5 to 100 $\mu$m.

The adhesive layer may be a layer itself having adhesion property, or a layer producing adhesion property by applied heat or pressure, and can be formed using, for example, a low softening point resin, an adhesive, a heat solvent or fillers.

The low softening point resin includes an ethylene copolymer such as ethylene-vinylacetate copolymer or ethylene-ethylacrylate copolymer, a polystyrene resin such as styrene-butadiene copolymer, styrene-isoprene copolymer, or styrene-ethylene-butylene copolymer, a polyester resin, a polyurethane resin, a polyolefin resin such as polyethylene or polypropylene, a polyvinyl ether resin, a polyacrylate resin such as polybutylmethacrylate, an ionomer resin, a cellulose, an epoxy resin, a polyvinyl chloride resin such as copolyvinylchloride-vinylacetate, polyvinyl alcohol and a polyvinyl alcohol derivative such as polyvinyl butyral. The adhesive includes modified or non-modified rosins such as rosin, hydrogenated rosin, rosin-maleic acid, polymeric rosin and rosin phenol, and terpenes and petroleum resins or their modified resins.

The heat solvent includes compounds which are solid at ordinary temperature and thermally reversibly liquefies or softens, concretely, monomolecular compounds such as terpineol, menthol, acetoamide, benzamide, cumarine, benzyl cinnamate, diphenylether, crown ether, camphor, p-methylacetophenone, vanillin, dimethoxybenzaldehyde, p-benzyldiphenyl, stilbene, margaric acid, eicosanol, cetylpalmitate, stearic amide, and behenylamine, waxes such as bees wax, candelilla wax, paraffin wax, ester wax, montan wax, carnauba wax, amide wax, polyethylene wax and microcrystalline wax, rosin derivatives such as ester gum, rosin-maleic acid resins and rosin phenol resins, a phenol resin, a ketone resin, an epoxy resin, a diallylphthalate resin, a terpene type hydrocarbon resin, a cyclopentadiene resin, a polyolefin resin, a polycaprolactam resin, and polyethylene oxides such as polyethylene glycol and polypropylene glycol. As the fillers, those used in the above described colorant layer can be optionally used.

The laminate sheet used in the invention comprises a transparent or semitransparent plastic film support and provided thereon, an adhesive layer. The transparent or semitransparent support includes a film of a plastic such as polyester, polyethylene phthalate, PEN or an ABS resin. The adhesive layer includes a layer of a heat adhesion resin such an ethylene-vinylacetate resin, an ethylene-ethylacrylate resin, an ethylene-acrylic acid resin, an ionomer resin, a polybutadiene resin, a polyamide resin, a polyurethane resin, a polyvinyl chloride resin, an acryl resin, a polystyrene resin, a polyester resin, an adhesive such as a phenol resin, a rosin resin, a terpene resin or a petroleum resin.

The thickness of the adhesive layer is 5 to 50 $\mu$m, according to the surface condition of the image forming layer.

The surface of the adhesive layer may be subjected to embossing processing in order to prevent blocking. On the surface of the plastic film support or between the support and the adhesive layer, a picture layer may be provided.

Heat adhesion is employed due to heating and pressure application. Adhesion is provided on either side or on both sides of the transferred material. As necessary, unnecessary portions may be cut off. In addition, in order to use an image as a medical diagnostic image, it is preferable to color the laminated material or the adhesive layer.

EXAMPLE

Hereinafter, the present invention will be detailed referring to Examples. However, the embodiment of the present invention will not be limited thereto.

Example 1

(Preparation of a thermal transfer material)

By mixing the following raw materials, a uniform ink solution having a dye was obtained.

| | |
|---|---|
| Dye A | 4 g |
| Dye B | 4 g |
| Polyvinyl butyral resin (BL-1: produced by Sekisui Chemical Industry) | 5 g |
| Methylethylketone | 200 cc |

On a 4.5 $\mu$m thick PET base, the above-mentioned ink solution was coated using a wire bar and dried to give a coating weight of 0.8 g/m$^2$ so that a thermal transfer material sample 2-1 having an image forming layer on the base was prepared. Incidentally, on the rear surface of the above-mentioned PET base, a nitrocellulose layer containing a silicone-modified urethane resin (SP-2105: produced by DaiNichi Seika) was provided as an anti-sticking layer.

Dye A

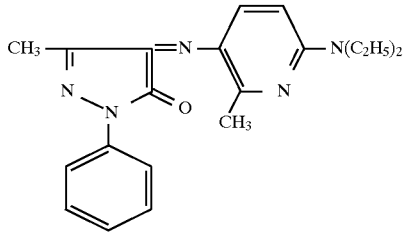

Dye B

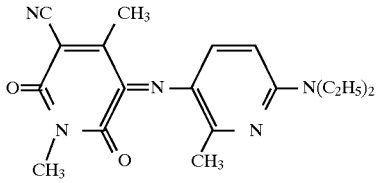

(Preparation of an image-receiving material)

A methylethylketone solution containing a polyester-modified silicone (X-24-8310, made by Shinetsu Kagaku Co., Ltd.) and a polyester resin (vylon, made by Toyo Boseki Co., Ltd.) was coated on a 170 $\mu$m PET (produced by Diahoyl Hext, the same hereinafter) support and dried to form an image-receiving layer having the polyester-modified silicone coating weight of 0.15 g/m$^2$ and the polyester resin coating weight of 5 g/m$^2$. Thus, image-receiving material sample No. 1-1 was obtained.

On Sample 1-1, the following layer a or b was provided, so that Samples 1-2 through 1-4 were prepared.

Sample 1-2: Layer b was provided on the image-receiving layer.

Sample 1-3: Layer a was provided on the image-receiving layer.

Sample 1-4: Layer b was provided on the side opposite the image-receiving layer.

Layer a: Using methylethylketone as a solvent, a polyvinyl alcohol solution was coated at a coating weight of 1.0 g/m$^2$.

Layer b: Silica whose average particle size was 3 $\mu$m was added to the polyvinyl alcohol solution, and similarly coated at a silica coating weight of 0.1 g/m$^2$.

An image composed of 300 dpi thin lines and spaces was outputted on each sample using a thermal printer CHE-C-S545 produced by Shinko Denki so that the resolution could be evaluated.

The evaluation criteria are as follows:

A: Excellent

B: Poor

The unevenness of the transfer image was evaluated at 10 μm to 1 cm pitch according to the following criteria:

A: The transfer image was observed using a 10 power magnifier, but no image unevenness was observed.

B: No image unevenness was visually observed, but the image unevenness was observed using a 10 power magnifier.

C: The image unevenness was visually observed.

D: The image unevenness was observed at a glance.

Table 1 shows results thereof.

TABLE 1

| Sample No. | Silica | Resolving power | Unevenness of transferred image | Glossiness Front face | Glossiness Rear face |
|---|---|---|---|---|---|
| 1-1 (Comp.) | None | A | A | 120 (glisten) | 150 (glisten) |
| 1-2 (Comp.) | Front face | B | D | 100 (excellent) | 150 (glisten) |
| 1-3 (Comp.) | None | A | B | 120 (glisten) | 150 (glisten) |
| 1-4* (Inv.) | Rear face | A | A | 120 (glisten) | 100 (excellent) |

Comp: Comparison, Inv.: Invention

*In Inventive Sample 1-1, a mirror image was recorded.

In Table 1, the term "front face" means the image forming layer side face, and the term "rear face" means the face of the support opposite the image forming layer side.

As is apparent from Table 1, the image formation method of the present invention provides neither transfer unevenness nor resolution reduction even if glossiness on the surface is reduced so that a favorable image can be obtained. When the surface glossiness is less than 80, transparency was reduced so as to be unacceptable.

Example 2

(Preparation of heat-developable light-sensitive material)

To 220 g of a toluene-methylethylketone mixed solution (weight ratio of 1:2), 30 g of silver behenate was added. The resulting mixture was dispersed for 20 hours in a ball mill so that a suspended solution of silver behenate was obtained.

To 1.5 g of the above-mentioned suspended solution, 1.3 g of a polyvinylbutyral 10% methylethylketone solution, 0.3 g of a cobalt bromide methanol solution (20 wt %), 0.2 g of a diphenylbromomethane toluene solution (10 wt %) and 0.1 g of solid iodine manually crushed in a mortar were added.

On a 10 μm thick transparent polyethylene terephthalate support, the resulting mixture was coated and dried to a lower image forming layer having a coating amount of 2.0 $g/m^2$ in terms of silver behenate. In addition, as an upper image forming layer, a 10% polyvinyl butyral methylethylketone solution containing 5% of 2,2'-methylenebis(4-ethyl-6-t-butylphenol) was coated and dried to give a coating amount of 2 $g/m^2$ in terms of polyvinyl butyral. Thus, light-sensitive material Sample 2-1 was obtained.

In the same manner as in Sample 2-1, Samples 2-2 and 2-3 were prepared.

Sample 2-2: A glossiness inhibition layer was coated on the upper image forming layer of Sample 2-1 to give a coating amount 0.1 $g/m^2$ of silica having an average particle size of 3 μm and 1.0 $g/m^2$ of polyvinyl alcohol using methylethylketone as a solvent.

Sample 2-3: Sample 2-3 was prepared in the same manner as in Sample 2-1, except that the surface of the PET support opposite the image forming layer was roughened so that glossiness was reduced.

A light-sensitive material sample prepared in the above-mentioned manner was subjected to image exposure to light, and then, subjected to heat development by means of a heated roller as shown in FIG. 1.

In FIG. 1, numeral 1 represents a heat developable light-sensitive material. Numeral 2 represents a heated roller (made of copper wherein the surface was coated with teflon). Numeral 3 represents a transport roller. Numeral 4 represents a laser emitting apparatus. Numeral 5 represents a polygonal mirror.

Figure 2:
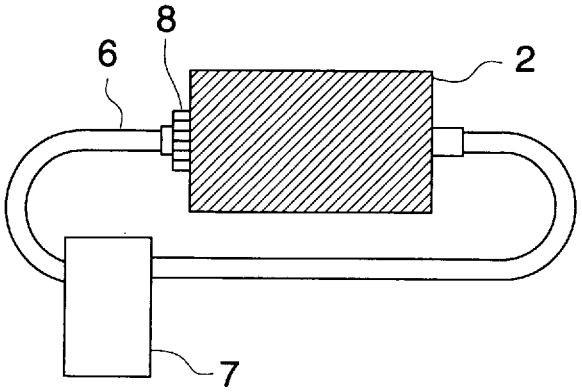
FIG. 2 is a side view showing a structure around the heated roller of FIG. 1.

Heat developable light-sensitive material 1 is exposed to light by device 4, transported by transport roller 3, and successively heat developed by means of roller 2, which is rotated through gear 8. As shown in FIG. 2, aforesaid roller is connected with a heater 7 provided with a circulation pump by means of pipe 6. Heat development was conducted for 10 seconds at 125° C. The light-sensitive material was conveyed in such a manner that the light-sensitive layer side contacted the heated roller. Relative sensitivity and glossiness were measured.

Here, sensitivity is represented by the inverse of exposure amount, and relative sensitivity is represented by a relative value when the inverse of the exposure amount necessary to obtain a density of 1.0 is defined as 100 for Sample No. 2-1. Incidentally, for the measurement of density, PDA-65 (a densitometer produced by Konica) was used. The results are shown in Table 2.

TABLE 2

| Sample No. | Silica | Relative sensitivity | Glossiness Front face | Glossiness Rear face |
|---|---|---|---|---|
| 2-1 (Comp.) | None | 100 | 122 | 150 |
| 2-2 (Comp.) | Image formation side | 90 | 118 | 150 |
| 2-3 (Inv.*) | None | 100 | 122 | 105 |

*In Inventive sample 2-3, a mirror image was recorded.

With regard to Sample 2-2, the surface glossiness was reduced before development. However, after development, silica was buried inside and the surface glossiness becomes strong. Concurrently with this, pressure traces of the rollers occurred in an irregular pattern on the surface due to heating. On the contrary, Sample 2-3 of the present invention was observed from the rear PET base side, wherein an image had extremely favorable surface glossiness and had no unevenness.

Further, the inventive sample has advantage that dirt or fingerprint, which is likely to adhere to the observation face (rear face side of the sample in the invention), can be easily wiped off without damaging an image, using water, a detergent or a solvent. Fingerprint traces on the layer having an image was not adversely affected in reading.

Example 3

On a 100 μm thick PET film, the following anchor layer, coloring layer, instabilizing layer and releasing layer were coated in this order so that a heat sensitive image forming material Sample 3-1 was prepared.

| | |
|---|---|
| Anchor layer | |
| Saturated polyester resin (Bylon 200, produced by Toyo Bohsha) | 0.04 g |
| Methylethylketone | 0.96 g |
| Coloring layer (dry thickness of 11.56 μm) | |
| $[Co(NH_3)_6]$ $(CF_3COO)_3$ | 0.09 g |
| 4-t-butyl-1,2-phthalaldehyde | 0.205 g |
| Vinyl chloride-vinyl acetate copolymer (VYHH produced by Union Carbide) | 0.4675 g |
| Acetone | 0.47 g |
| Methylethylketone | 1.40 g |
| Unstabilizing agent layer (dry thickness of 1.3 μm) | |
| Methyl gallate (produced by Tokyo Kasei) | 0.45 g |
| Polyvinyl acetal resin (KS-1: produced by Sekisui Chemical Industry) | 0.2 g |
| Methylethylketone | 3.55 g |
| Releasing layer (dry thickness of 0.2 μm) | |
| X24 8300 (produced by Shinetsu Chemical) | 0.1 g |
| Methylethylketone | 0.525 g |

Sample 3-2 was prepared in the same manner as in Sample 3-1 except that silica of an average particle size of 3 μm was added in an amount of 0.1 g/m$^2$ in place of X24 in the releasing layer.

Sample No. 3-3 was prepared in the same manner as in Sample 3-1, except that the surface of the support opposite the coloring layer was coated in an amount of 1.0 g/m$^2$ of polyvinyl alcohol and in an amount of 0.1 g/m$^2$ of silica having an average particle size of 3 μm using a methylethylketone solvent.

On the rear surface of a 6 μm PET film (T0100: produced by Diafoil Hoechst), a SP712 (produced by Dainichi Seika Co. Ltd.) layer was provided to give a dry thickness of 0.2 μm. Thus, an anti-heat-adhesion film was obtained. The film obtained above was superposed on the above-mentioned image forming material sample. The thermal head was applied from the PET film of the anti-heat-adhesion film so that image recording was conducted under the following recording conditions. Incidentally, in Sample 3-3, a mirror image was recorded.

Table 3 shows the surface glossiness, the maximum density (Dmax) and the resolution, of each image. Density was measured by PDA-65 (as described above).

(Recording conditions)

The primary scanning recording density and the secondary scanning recording density were 8 dots/mm, respectively. Recording electrical power: 0.6 W/dot Heating time: The heating time was adjusted to 16 steps between 20–0.2 msec.

TABLE 3

| | Glossiness | | | Resolution |
|---|---|---|---|---|
| Sample No. | Front face | Rear face | Dmax | (300 dpi) |
| 3-1 (Comp) | 125 | 150 | 3.1 | 300 |
| 3-2 (Comp) | 105 | 150 | 2.5 | 280 |
| 3-3 (Inv.) | 125 | 100 | 3.0 | 300 |

The present invention provided favorable images in which surface glossiness was reduced without lowering density or resolution. In addition, in a durability test by means of continuous image outputting, in Sample 3-2, the thermal head was markedly deteriorated by abrasion. However, the present invention was favorable.

Example 4

After an image has been formed in Sample 1-4 of Example 1, a laminate material was provided on the image-receiving layer having the formed image. The laminate material was a 50 μm PET base on which an adhesive layer comprised of 0.5 g/m$^2$ of an ethylene-ethylacrylate copolymer was coated.

In this occasion, the thickness of the support of the image-receiving material was changed so that samples 4-1 through 4-5 were prepared. Evaluation on interference stripes was visually checked. Observation was conducted from the surface of the support opposite the image-receiving layer.

Table 4 shows the results thereof. Incidentally, even if the thickness of the support of the laminate material was changed, no change resulted. If the thickness of the support was extremely thin, wrincklet or breakage occurred in laminating, so that they were of no practical use.

Incidentally, as a lamination device, a device having a heating and pressure roller was used. The surface temperature of the roller was 130° C., and the pressure was 5 kg/cm$^2$.

TABLE 4

| Sample No. | Thickness of a support (μm) | Interference stripes |
|---|---|---|
| 4-1 (Inv.) | 150 | Slightly visible |
| 4-2 (Inv.) | 130 | Scarcely invisible |
| 4-3 (Inv.) | 100 | Cannot be observed |
| 4-4 (Inv.) | 50 | Cannot be observed |
| 4-5 (Inv.) | 10 | Cannot be observed |

As shown in Table 4, in the support thickness range tested, there were no substantial problems regarding the interference stripes.

What is claimed is:

1. A method of forming a transmission image on an image forming material comprising a transparent support having a first surface side, a second surface side and, on the first surface side, an imaging layer, the method comprising imagewise exposing said imaging layer to form a mirror image on the imaging layer so that the formed image is visible from the second surface side, the second surface side having a glossiness of 80 to 115, wherein the imaging layer is an image receiving layer and the image forming is carried out by transferring the image from an ink layer onto the image receiving layer by a thermal transfer method, the imaging layer is a heat sensitive layer and the image forming is carried out by imagewise heating the heat sensitive layer by a heat sensitive recording method, or the imaging layer is a heat developable layer and the image forming is carried out by imagewise exposing the heat developable layer and then bringing the exposed heat developable layer into contact with a heated roller.

2. The image forming method of claim 1 wherein the image forming material further comprises a protective sheet or a protective resin layer on the imaging layer, the imaging layer having an image.

3. The image forming method of claim 2, wherein a maximum density of the formed image is not less than 2.5.

4. The image forming method of claim 2, wherein the support has a thickness of 2 to 200 $\mu$m.

5. The image forming method of claim 2, wherein the support is comprised of a polymer selected from the group consisting of polyethylene terephthalate, a syndiotactic polystyrene and polyethylene naphthalate.

6. The image forming method of claim 2, wherein the surface of the support opposite the imaging layer is roughened.

7. The image forming method of claim 2, wherein the image forming material has a thickness of 10 to 140 $\mu$m.

* * * * *